US005148414A

United States Patent [19]

Graff et al.

[11] Patent Number: 5,148,414

[45] Date of Patent: Sep. 15, 1992

[54] ELECTRODYNAMIC ULTRASONIC TRANSDUCER

[75] Inventors: Alfred Graff, Essen; Michael Wächter, Ratingen, both of Fed. Rep. of Germany

[73] Assignee: Mannesmann Aktiengesellschaft, Düsseldorf, Fed. Rep. of Germany

[21] Appl. No.: 786,254

[22] Filed: Nov. 1, 1991

[30] Foreign Application Priority Data

Nov. 6, 1990 [DE] Fed. Rep. of Germany ..... 4035592

[51] Int. Cl.[5] ..... H04R 23/00

[52] U.S. Cl. ..... 367/140; 73/643

[58] Field of Search ..... 73/643; 367/140

[56] References Cited

U.S. PATENT DOCUMENTS 3,963,980 6/1976 Shkarlet ..... 73/643

4,058,002 11/1977 Moran ..... 73/643

FOREIGN PATENT DOCUMENTS 426716 1/1975 U.S.S.R. ..... 73/643

*Primary Examiner*—J. W. Eldred

*Attorney, Agent, or Firm*—Cohen, Pontani, Lieberman & Pavane

[57] ABSTRACT

An electrodynamic ultrasonic transducer, for testing a workpiece, has a pair of spaced permanent magnets, a transducer coil, a concentrator, and a non-ferromagnetic member which partially surrounds the concentrator. In order to concentrate the magnetic lines of flux, the concentrator has a cross-sectional area which is smaller than the cross-sectional area of the adjacent permanent magnets. A transducer coil is acted on by a high frequency transmission pulse, whereby ultrasonics is produced in the workpiece to be tested.

5 Claims, 2 Drawing Sheets

(A-A)

ELECTRODYNAMIC ULTRASONIC TRANSDUCER

FIELD OF THE INVENTION

The present invention relates to an electrodynamic ultrasonic transducer and, specifically, to an ultransonic transducer wherein the surface area of the concentrator is smaller than the surface area of the pole surfaces of the adjacent (abutting) permanent magnets.

BACKGROUND OF THE INVENTION

Electrodynamic ultrasonic transducers are used predominantly in the field of the non-destructive testing of workpieces.

Such electrodynamic ultrasonic transducers consist of magnet systems which introduce magnetic lines of flux into the workpiece to be tested. A coil system arranged in the vicinity of the surface of the workpiece is acted on by high frequency alternating current so as to inductively produce eddy currents in the surface of the workpiece. The electrons of the workpiece which are moved in this manner interact with the magnetic field introduced. As a result, a coupling to the crystal lattice of the workpiece is produced, and sound is produced which can be used for testing the workpiece. Such an electrodynamic ultrasonic transducer of the type indicated above is known from an unexamined German Patent Application 32 34 424. The electrodynamic ultrasonic transducer consists, in that case, of a magnet arrangement in which magnets having the same polarity are arranged facing each other over ferrite parts lying between them.

In this known embodiment, the surface area of the ferrite parts adjacent and parallel to the pole surfaces of the magnets are at least as large as the cross-sectional area of the pole surface themselves. It must, however, be noted in connection with this known arrangement that while magnetic lines of flux are concentrated on the region of the ferrite part, they only in part, form a magnetic return through the workpiece to be tested. In other words, magnetic lines of flux also emerge laterally, i.e., not directly towards the surface of the workpiece, and, thus establish a magnetic return via the air. The disadvantage is therefore that, in this case, only a part of the entire available magnetic field is used for ultrasonic testing.

SUMMARY OF THE INVENTION

An object of the present invention is to further develop an inexpensive electrodynamic ultrasonic transducer of the type discussed above wherein the magnetic field density used for ultrasonic testing on the workpiece surface is substantially increased.

In an electrodynamic ultrasonic transducer of this type, the object is achieved in accordance with the present invention in the manner that the cross-sectional area of the concentrator which is disposed parallel to the pole surface of the permanent magnets is smaller than each of the pole surfaces of the permanent magnets, the space remaining between the pole surfaces around the concentrator is filled by a correspondingly shaped non-ferromagnetic member, and that the concentrator is displaced relative to the bottom surface of the permanent magnets and the non-ferromagnetic member towards the workpiece surface.

An advantage and object of the present invention is the realization that an increase in the magnetic field density which is introduced into the workpiece is achieved in a very simple and yet very effective manner. In accordance with the present invention the concentrator has a smaller cross-sectional area than each of the pole surfaces of the permanent magnets. As a result, all magnetic lines of flux are constricted or condensed in a direction towards the concentrator. Lateral emergence of magnetic lines of flux on the other sides not facing the surface to be tested is in this way prevented in a very simple manner. By choosing the cross-sectional area of the concentrator smaller than those of the permanent magnets and by displacing the concentrator towards the surface of the workpiece as described, the greatest part of the magnetic field density will be directed to the surface of the workpiece and will form the magnetic return therewith so that it will be used for the production of ultrasonics.

In the present invention, the concentrator advantageously consists of a soft-magnetic composite powder material. By utilizing almost the entire magnetic field density for ultransonic testing, the present invention permits an advantageous use of permanent magnets. The use of a concentrator of soft-magnetic composite powder leads to an efficient utilization of the magnetic field for the production of ultrasonics. This is due to the fact that while soft-magnetic composite powder materials conduct magnetic lines of flux, they are of high electrical resistance. Consequently, the magnetic field is conducted, without weakening, to the surface of the workpiece without, however, producing ultrasonics in the concentrator itself. This has the advantage that the entire available energy can be utilized for the production of ultrasonics in the workpiece.

The construction of such a magnet system, in which pole surface of the same polarity face each other, is difficult due to the repulsion force of the magnets with respect to each other. With such an alignment of the pole surfaces, the magnets endeavor to move away from each other, and the forces acting in this connection increase with decreasing distance between the pole surfaces. For this reason, the proposal of the invention to fill the space remaining between the pole surfaces around the concentrator with a correspondingly shaped non-ferromagnetic member leads to facilitating the positioning of the magnets with respect to each other and of the concentrator. Under operating conditions, this non-ferromagnetic member furthermore secures the position of the concentrator.

To bring the magnetic field in a suitable manner towards the surface of the workpiece, the concentrator is provided, in a preferred embodiment, with a projection on the side surface of the workpiece. This projection, in a particularly simple manner, effects a focusing of the magnetic lines of flux onto and into the workpiece to be tested. In a further preferred embodiment, the non-ferromagnetic member is made of a plastic material. As a result, the non-ferromagnetic member is advantageously simple to machine and to handle. In yet another preferred embodiment of the present invention, a plurality of magnet arrangements are aligned to form a test row. This results in a simple and compact testing device.

In a further preferred embodiment of the present invention, the non-ferromagnetic member is provided with a bore hole which is arranged perpendicular to the surface of the workpiece to be tested and spaced from the concentrator. This has the advantage that the connecting lines required for the transducer coil can be passed through said bore hole.

In a final preferred embodiment of the present invention, the outwardly directed pole surfaces of the magnets are connected in a magnetically conductive manner to a magnetic return member which is provided with suitable surfaces which can be applied against the surface of the workpiece to be tested. This results, in an advantageous manner, in a good return action with respect to the magnetic lines of flux.

BRIEF DESCRIPTION OF THE DRAWINGS

An embodiment of the electrodynamic ultrasonic transducer will be explained further with reference to the drawings, in which.

DETAILED DESCRIPTION OF THE PRESENTLY PREFERRED EMBODIMENTS

Figure 1:
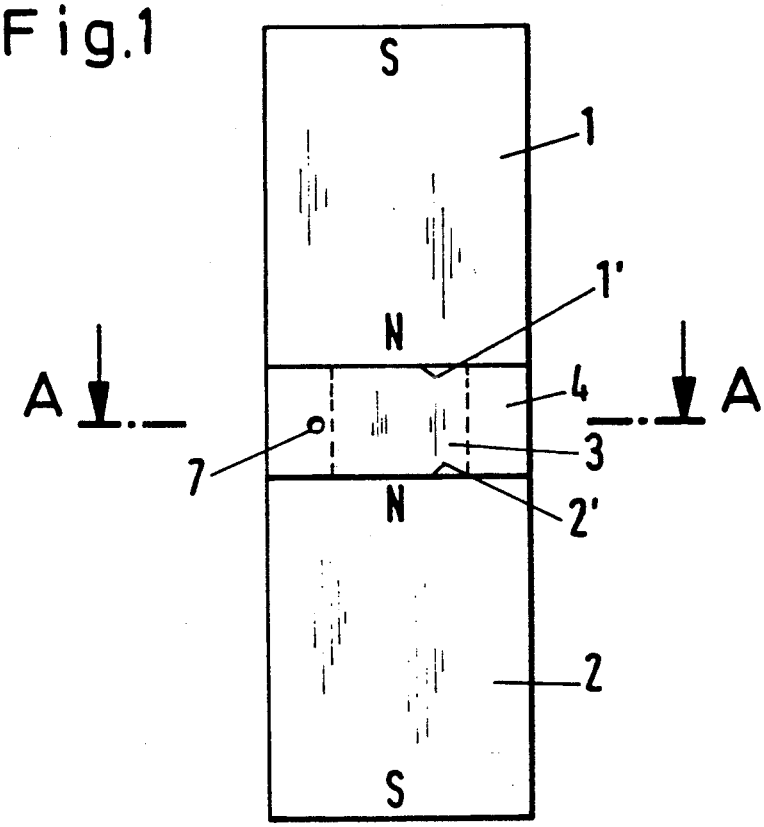
FIG. 1 is a top view of a magnet arrangement having a concentrator.

FIG. 1 shows the arrangement of the permanent magnets 1, 2 and pole surfaces 1', 2' which face each other and have the same polarity. The concentrator 3 is inserted between magnets 1, 2 and is held in place by the non-ferromagnetic member 4 which partially surrounds the concentrator 3. As a practical matter, the non-ferromagnetic member 4 is developed in such a manner that it terminates flush with the outer contour of the permanent magnets 1, 2.

Figure 2:
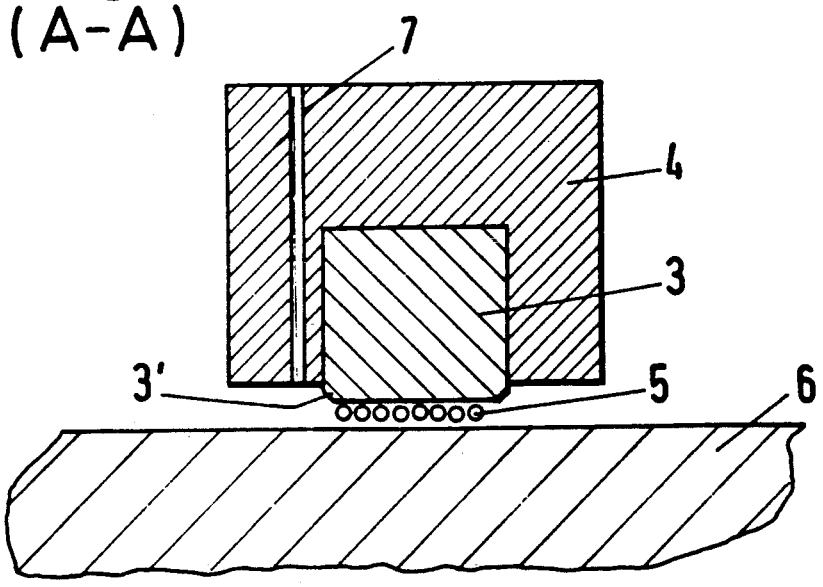
FIG. 2 is a sectional view along the line A—A of FIG. 1.

FIG. 2 is a sectional view along the line A—A and shows the non-ferromagnetic member 4 partially surrounding the concentrator 3. The cross-section of the non-ferromagnetic member 4 is substantially coextensive with the cross-sectional contour of the pole surface 1', 2' of the permanent magnets 1, 2. The concentrator 3 is arranged within the cross-sectional contour of the permanent magnets in a predetermined position so that the concentrator 3 projects outwards beyond the bottom surface of the permanent magnets towards the workpiece surface 6. It can clearly be noted that the cross-section of the concentrator 3 is substantially smaller than the cross-sectional area of the pole surfaces 1', 2'. The projection 3' of the concentrator 3 which faces the surface protrudes somewhat the boundary line of the cross-sectional contour of the magnets 1, 2 and of the non-ferromagnetic member 4 towards the surface of the workpiece 6. The transducer coil 5 is arranged between the projections 3' and the workpiece surface 6 and is acted on by a high frequency transmission pulse, whereby the ultrasonics is produced in the workpiece 6 to be tested.

Figure 3:
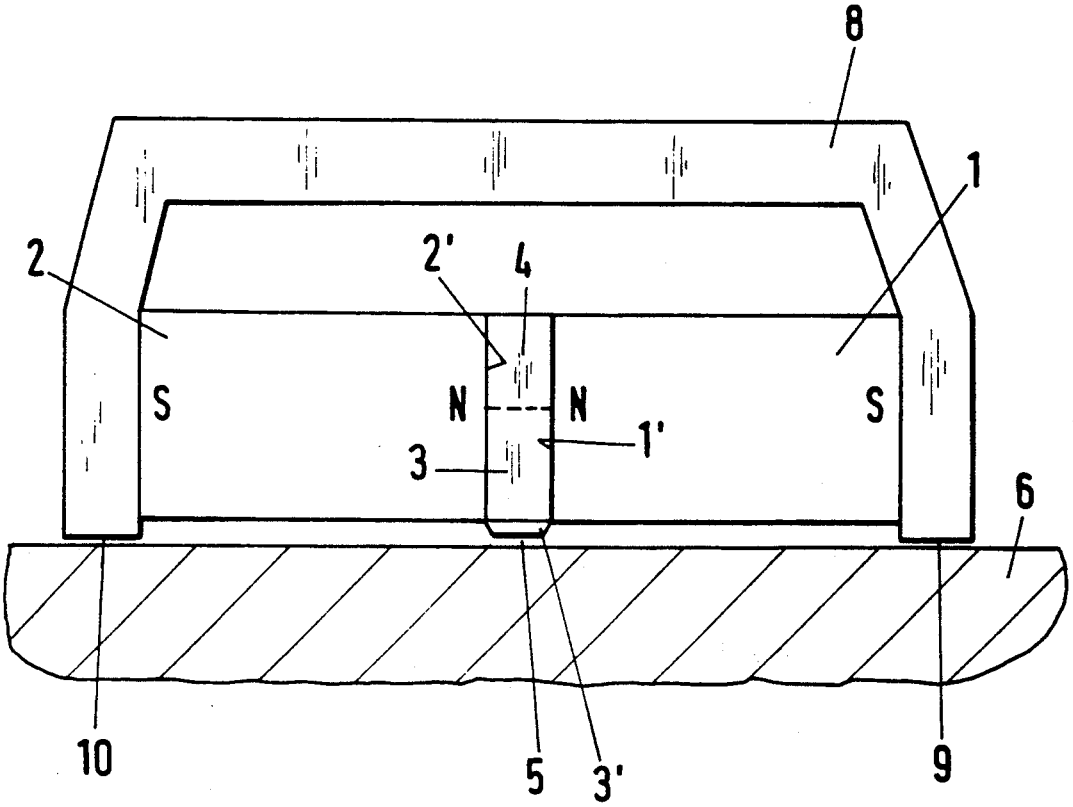
FIG. 3 is a side view of the magnet arrangement having a return member.

FIG. 3 shows the magnet arrangement in a side view, including a return member 8 for achieving magnetic return. The return member 8 is applied in a magnetically conductive manner to the outward directed pole ends of the magnets 1 and 2. Contact surfaces 9 and 10 are provided on the return member 8, for positioning the return member 8 onto the surface 6 of the workpiece to be tested. It provides for the magnetic return, i.e. the returning of the magnetic lines of flux, and, the establishing of a closed magnetic circuit. The contact surface 9 and 10 are so dimensioned that, along with surfaces 9 and 10, the transducer coil 5 can also be placed in a suitable position on the workpiece surface 6. The return member 8 consists of ferromagnetic material.

The cross-sectional area of the concentrator cannot be made indefinitely small with respect to the cross-sectional area of the magnets or the pole surfaces. The cross-section of the concentrator must be sufficiently large to receive the magnetic field density which is present. This ability depends, on the one hand, on the permeability and the saturation induction, and, thus, on the material, and on the other hand, on the energy product of the spatial dimensions of the magnets. In this manner, and depending upon the material used and the magnetic field strength of the magnets, the minimum spatial dimensions of the concentrator can be obtained. These minimum dimensions must be then satisfied, depending on the magnet material and the spatial dimensions and on the material selected for the concentrator.

It should be understood that the preferred embodiment and the examples described are for illustrative purposes only and are not to be construed as limiting the scope of the present invention which is properly delineated only in the appended claims.

What is claimed is:

1. An electrodynamic ultrasonic transducer for testing a workpiece comprising:
   a) a pair of spaced permanent magnets each having a first pole surface of the same polarity facing each other, said pole surfaces having a cross-section;
   b) means within said space between said permanent magnets for concentrating the magnetic lines of flux from said magnets, concentrating means being displaced from said permanent magnets toward said workpiece and having a cross-sectional area which is disposed parallel to said pole surfaces and which is smaller than said cross-sections of said permanent magnets so as to leave a remaining space;
   c) a non-ferromagnetic member disposed within said remaining space and partially surrounding said concentrating means; and
   d) a transducer coil on said concentrating means so as to face said workpiece when said transducer is in use.

2. The ultrasonic transducer of claim 1, wherein said concentrating means is composed of a soft magnetic composite powder material and wherein said concentrating means comprises a portion projecting from said magnets toward said workpiece; and said transducer coil being mounted on said projection.

3. The ultrasonic transducer of claim 1, wherein the said non-ferromagnetic member is composed of a plastic material.

4. The ultrasonic transducer of claim 1, wherein said non-ferromagnetic member has a bore hole parallel to said pole surface and spaced from said concentrating means.

5. The ultrasonic transducer of claim 1, wherein each of said permanent magnets comprises an additional pole surface facing away from a respective one of said first pole surfaces and further comprising a return member having a pair of contact surfaces for application against said workpiece, said return member being connected in a magnetically conductive manner to said additional pole surfaces of said pair of magnets so as to return said magnetic lines of flux generated by said permanent magnets.

* * * * *